US005865007A

United States Patent [19]

Bowman et al.

[11] Patent Number: 5,865,007

[45] Date of Patent: Feb. 2, 1999

[54] INTEGRALLY MOLDED REINFORCED GRATING

[75] Inventors: Steven J. Bowman, Stephenville; Gregory S. Foskey, Granbury; Wendell W. Hollingsworth; R. David Lee, both of Stephenville; Ethan A. Love, Fort Worth; Kristin P. Mathis-Pierson, Stephenville; James H. Randle, Granbury; Troy L. Truss, Stephenville, all of Tex.

[73] Assignee: Composite Structures International, Inc., Dallas, Tex.

[21] Appl. No.: 957,985

[22] Filed: Oct. 27, 1997

[51] Int. Cl.[6] ..... E04C 2/42

[52] U.S. Cl. ..... 52/664; 52/309.6; 52/309.7; 52/663; 52/177; 428/107; 428/327

[58] Field of Search ..... 52/108, 180, 181, 52/309.1, 309.6, 309.7, 656.8, 663, 664, 666, 669, 177; 428/131, 139, 107, 147, 327

[56] References Cited

U.S. PATENT DOCUMENTS

| | | | |
|---|---|---|---|
| D. 374,727 | 10/1996 | Emanuele et al. . | |
| 1,650,055 | 11/1927 | Tregillus . | |
| 3,772,419 | 11/1973 | Schoening . | |
| 3,943,675 | 3/1976 | Wyss | 52/177 |
| 4,164,439 | 8/1979 | Coonrod . | |
| 4,244,768 | 1/1981 | Wiechowski et al. . | |
| 4,289,563 | 9/1981 | Wiechowski et al. . | |
| 4,382,056 | 5/1983 | Coonrod . | |
| 4,555,886 | 12/1985 | Wiechowski . | |
| 4,760,680 | 8/1988 | Myers . | |
| 4,780,166 | 10/1988 | Hunter . | |
| 4,812,343 | 3/1989 | Kiekhaefer et al. . | |
| 4,897,299 | 1/1990 | Kawachi et al. . | |
| 5,026,447 | 6/1991 | O'Connor . | |
| 5,172,535 | 12/1992 | Jongh et al. . | |
| 5,285,613 | 2/1994 | Goldsworthy . | |
| 5,286,320 | 2/1994 | McGrath et al. . | |
| 5,332,462 | 7/1994 | Myers . | |
| 5,562,047 | 10/1996 | Forney et al. . | |

*Primary Examiner*—Christopher Kent
*Assistant Examiner*—Yvonne Horton-Richardson
*Attorney, Agent, or Firm*—Calfee, Halter & Griswold LLP

[57] ABSTRACT

An integral reinforced resin grating structure having a plurality of load bars having a height dimension and a neutral axis and a plurality of cross bars integrally connected with said load bars. The cross bars may have a height less than the load bar height. The upper surface of the cross bars may be flush with the upper surface of the load bars. The lower surface of the cross bars may be located near or above the neutral axis of the load bars. The cross bars and load bars are reinforced with rovings placed along their respective longitudinal axis. The load bars have longitudinal rovings placed below the lower surface of the cross bars. Above the lower surface of the cross bars, the load bar rovings are interwoven with the cross bar rovings.

For improved plastic reinforced grating structures having increased surface hardness and abrasion resistance, tabular alumina or other materials having a Mohs hardness of approximately 7 or higher may be added to the resin.

66 Claims, 4 Drawing Sheets

INTEGRALLY MOLDED REINFORCED GRATING

FIELD OF THE INVENTION

The present invention pertains generally to reinforced resin grating and more particularly to an apparatus of integrally molded fiberglass reinforced grating.

BACKGROUND OF THE INVENTION

Fiberglass reinforced grating structures have several attractive features such as increased corrosion resistance, simple fabrication and installation, a high resistance to flame and sparks, slip-resistance, and a high strength-to-weight ratio. A disadvantage inherent in the design of fiberglass reinforced grating structures is the tradeoff of increased corrosion resistance at the expense of longitudinal strength. When uni-directional strength is important, pultruded grating is the preferred method of manufacture. Pultruded grating is typically produced by first making the load bars and cross bars by the pultrusion process and then assembling the bars together, resulting in a final product which is not an integral structure. Thus pultruded grating has a disadvantage of requiring secondary processing for the attachment and interconnection of the cross bars to the load bars as well as requiring the sealing of joints for corrosion resistance. Another disadvantage of pultruded grating is that the holes drilled in the load bars for insertion of the cross bars result in a decrease in strength of the structure. Another disadvantage of pultruded grating is it has inferior corrosion resistance due to the penetration of corrosive material through the intersections created by the drilled holes in the grating structure. Further, pultruded grating has reduced impact resistance in comparison to molded grating due to the lower resin content.

Prior art molded grating methods typically create grating having reinforcement material aligned in two directions and interwoven throughout the entire height of the grating for bi-directional strength. Thus where strength in one direction is primarily needed, molded grating has the disadvantage in that relatively expensive plastic resin material is not utilized in the most efficient structural manner. Another disadvantage of molded grating is that reinforcement is added to both load and cross bars in equal amounts for bi-directional strength while pultruded grating primarily reinforces the load bars for strength primarily in one direction. This results in molded grating being relatively more expensive and lower in strength in comparison with pultruded grating. In addition, the greater amount of expensive plastic resin used to manufacture the grating increases the processing time and costs. Further, molded grating has the disadvantage of allowing fluids to pool in the open areas of the grating.

Therefore, a more economical process is desired for producing a fiber reinforced plastic grating having an improved design which more efficiently utilizes expensive plastic resin and reinforcement material. In addition, an integrally made grating structure is also desired which eliminates the need for secondary processing. Furthermore, an improved fiber reinforced plastic grating article having greater structural strength and rigidity while having a lower weight yet maintaining corrosion and impact resistance is highly advantageous.

SUMMARY OF THE INVENTION

The invention provides in one aspect a reinforced resin grating comprising a plurality of load bars having a height dimension, and an upper surface; a plurality of cross bars having an upper surface and a lower surface; the cross bars transversely connected to the load bars; at least one cross bar having a height less than the load bar's height; and the load bars having rovings along its longitudinal axis from its lower surface to the lower surface of the cross bar.

The invention provides in another aspect a reinforced resin grating comprising a plurality of load bars having a height dimension, an upper surface and a neutral axis; a plurality of cross bars having a lower surface and an upper surface; a plurality of longitudinal rovings in the load bar placed below the neutral axis; the cross bars being transversely connected to the load bars; and at least one of the cross bars having its lower surface located at about the neutral axis.

The invention provides in yet another aspect an integrally molded reinforced resin grating comprising a plurality of load bars having an upper surface and a neutral axis; a plurality of cross bars having a lower surface and an upper surface; a plurality of longitudinal rovings in the load bars placed below the neutral axis; the cross bars being transversely connected with the load bars; and at least one of the cross bars having its lower surface located above the neutral axis.

The invention provides in still another aspect a reinforced resin grating comprising a plurality of load bars; a plurality of cross bars transversely connected with the load bars; the cross bars and the load bars having longitudinal reinforcement with the cross bar reinforcement interwoven with the load bar reinforcement; and the resin containing an additive selected from the group comprising: tabular alumina, quartz powder, tungsten carbide powder, ceramic powder, aluminum oxide powder or other material having a Mohs hardness of 7 or higher.

These and other aspects of the invention are herein described in particularized detail with reference to the accompanying Figures.

DETAILED DESCRIPTION OF THE FIGURES

DETAILED DESCRIPTION OF PREFERRED AND ALTERNATE EMBODIMENTS

Figure 1:
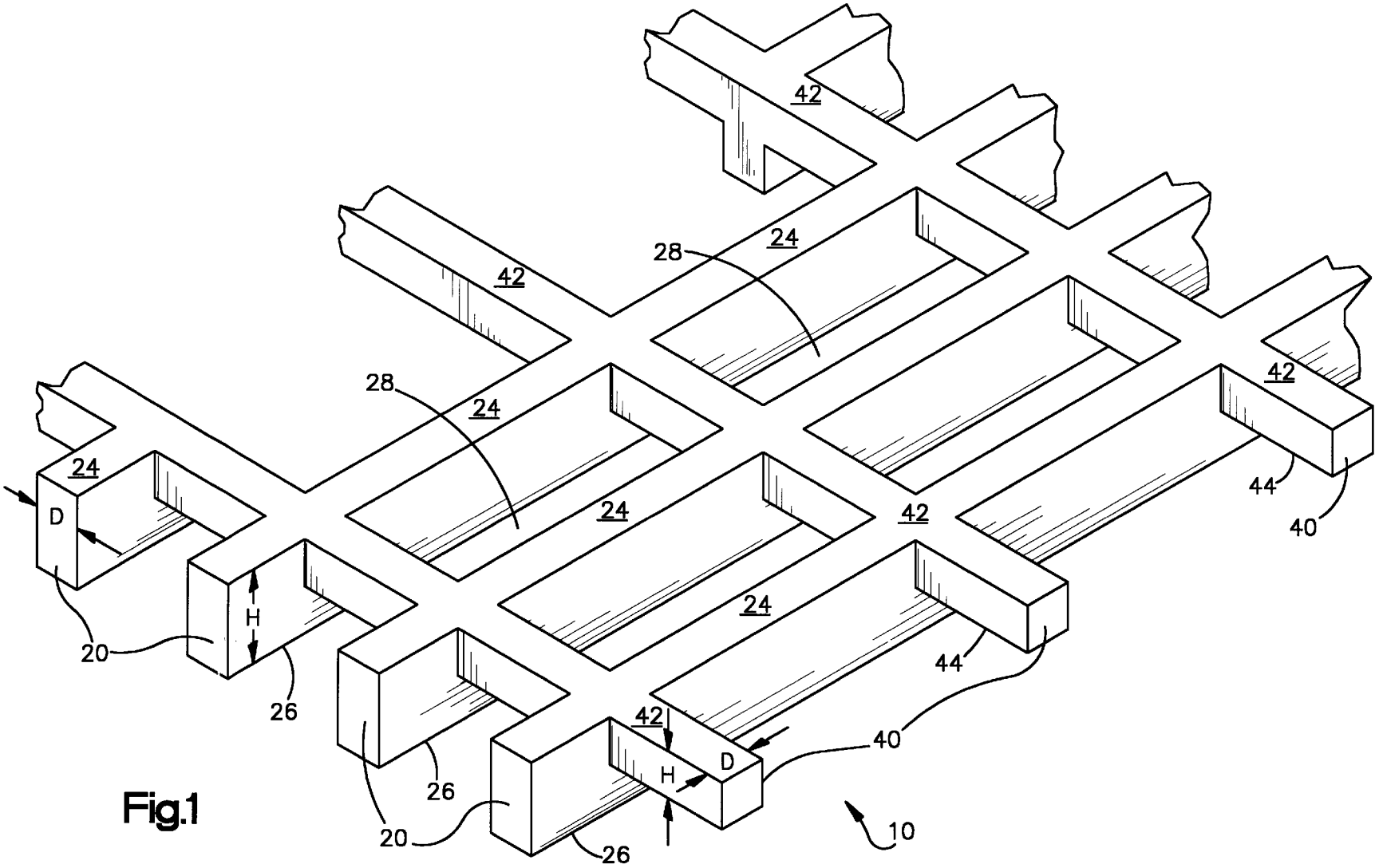
FIG. 1 is a schematic perspective view showing a section of a grating article of the present invention.
Figure 2:
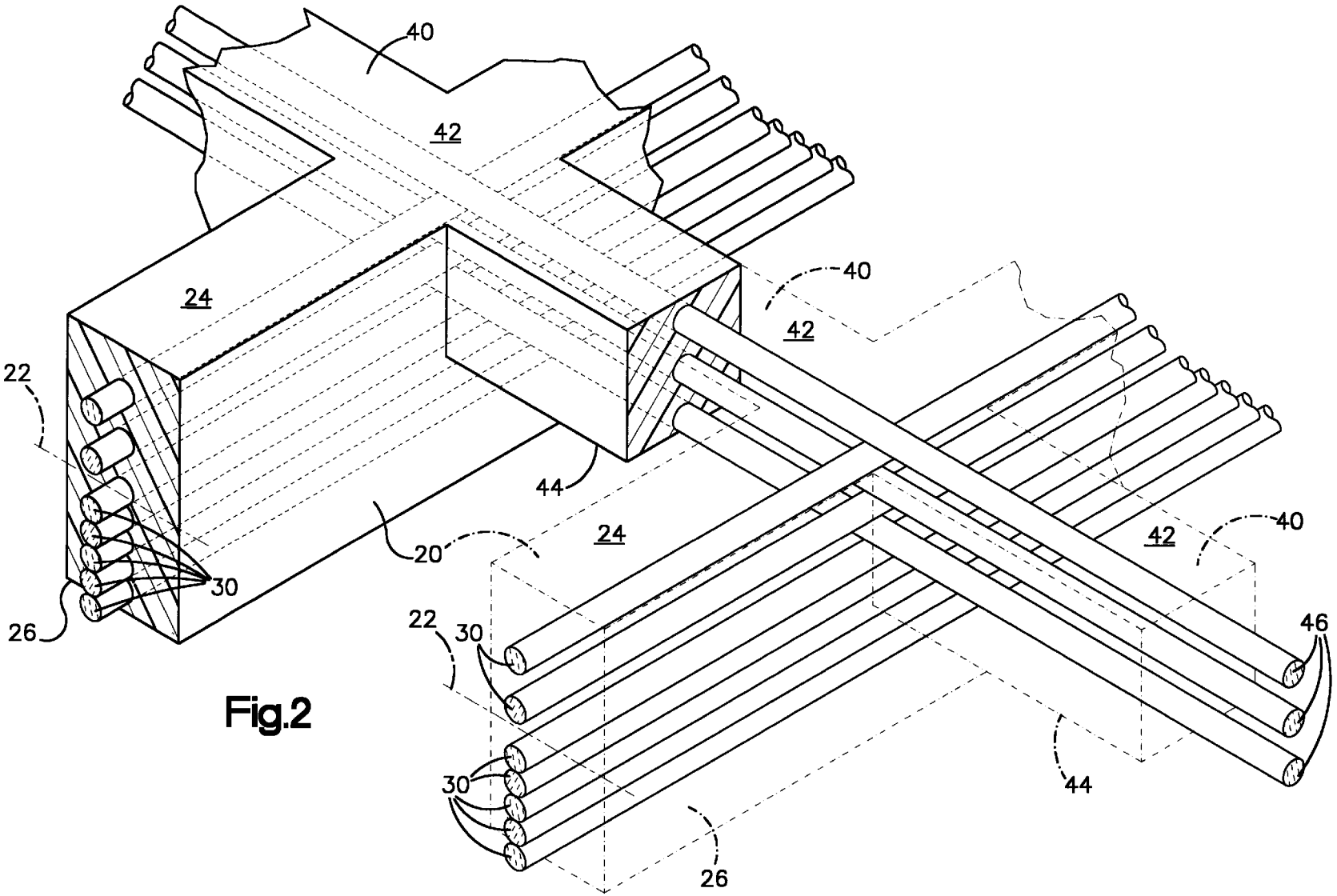
FIG. 2 is a schematic perspective cut away view of the grating article as shown in FIG. 1.
Figure 3:
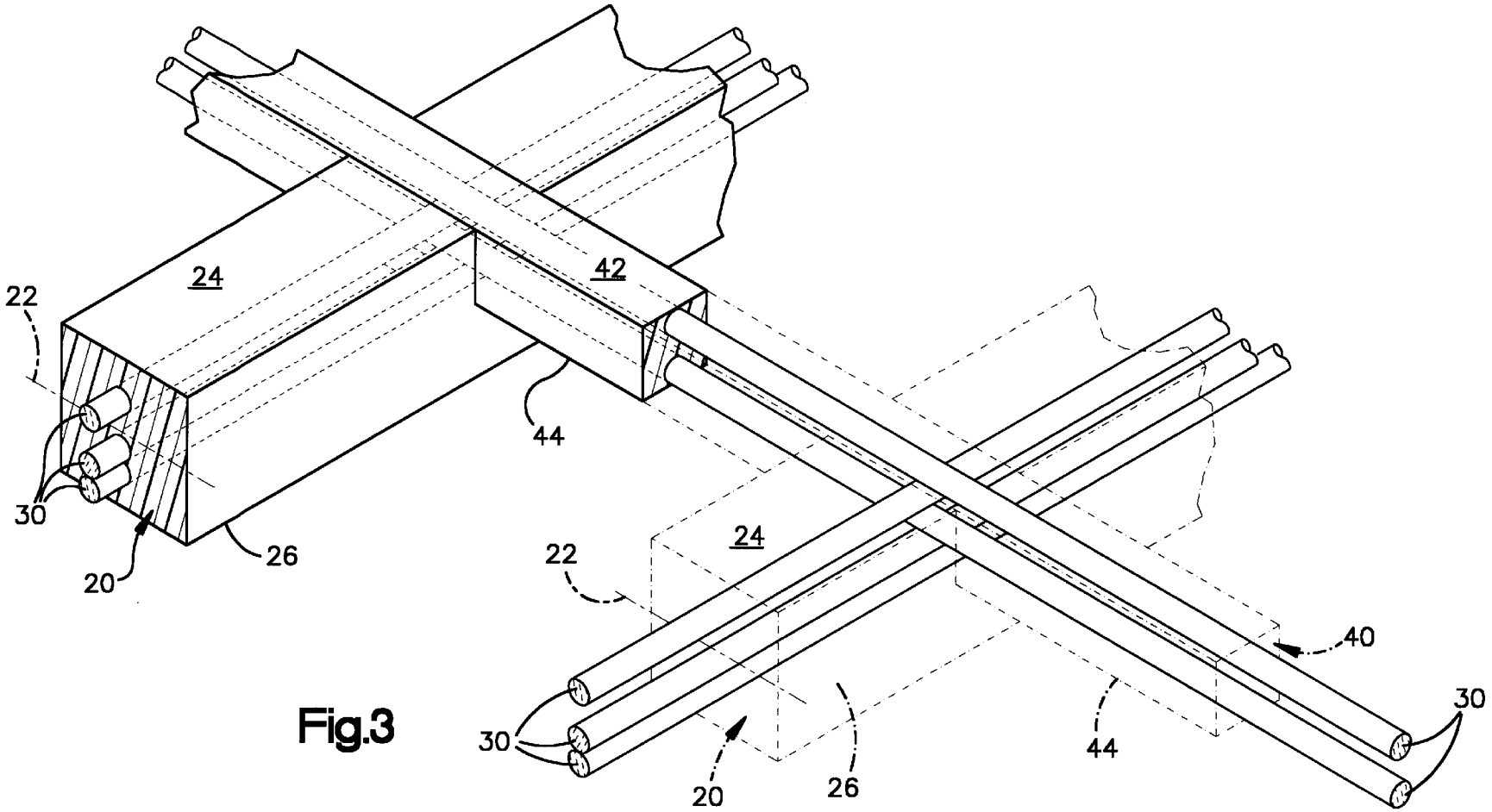
FIG. 3 is a schematic cross-sectional view of a grating article having a square cross section of the present invention.

Referring now to FIGS. 1–3, an integral grating article made of fiberglass reinforced plastic is shown generally at 10. This grating of the present invention has the beneficial features of both molded and pultruded manufacturing with very few drawbacks. The integrally molded grating 10 is formed having a plurality of reinforced load bars 20 and a plurality of reinforced cross bars 40 which lie transverse with respect to the load bars 20. The plurality of cross bars 40 are integrally molded with the load bars 20. It is preferred that the load bars 20 and cross bars 40 be mutually parallel and equally spaced with respect to each other. The load bars are spaced on centers a distance L and the cross bars are spaced on centers of a distance C. The load bar spacing L is less than the cross bar spacing C. It is preferred that the cross bar spacing C be in the range of 2–5 times the spacing of L. It is additionally preferred that the cross bars 40 be perpendicular to the load bars 20. The interconnection of the cross bars 20 and the load bars 40 form a grid or mesh 28, where the open space of the mesh can be in the shape of a parallelogram, a rectangle, a diamond or square.

Figure 4:
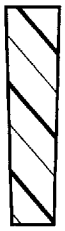
FIGS. 4–11 are schematic cross-sectional views of the of the load bars or cross bars of the grating article of the present invention.
Figure 5:
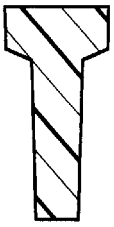
Figure 6:
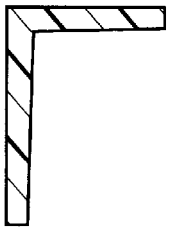
Figure 7:
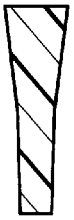
Figure 8:
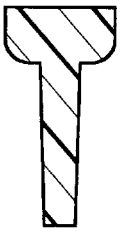
Figure 9:
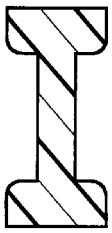
Figure 10:
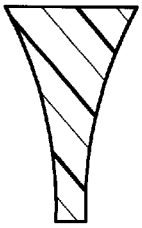
Figure 11:
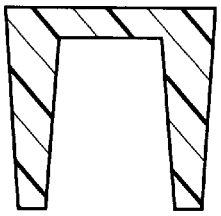

The cross section of the load bars 20 and the cross bars 40 may be of any structurally feasible shape such as square, channel, rectangular as shown in FIG. 4, T-shaped as shown in FIGS. 5 and 8, L shaped as shown in FIG. 6, Double Taper as shown in FIG. 7, I-shaped as shown in FIG. 9, Parabolic as shown in FIG. 10, or M-shaped as shown in FIG. 11, with the cross-section having a height H and a width D. The shape of the cross section of the load bars 20 may be different than the shape of the cross bars 40. It is preferred that the cross section of the load bars 20 be rectangular. It is more preferable that the cross-section of the load bars 20 be T-shaped. It is preferred that the cross-section of the cross bars 40 be rectangular. For ease of extraction from the mold, it is additionally preferred that the load bars 20 and cross bars 40 each have a slightly tapered cross section by a draft angle in the range of about 1–3 degrees.

Each cross bar 40 has a top surface 42 and a lower surface 44, and it is preferred that each top surface 42 be flush with the top surface 24 of each load bar 20. The height of the cross bars 40 is less than the height of the load bars 20, such that the lower surface 44 of each cross bar 40 is located above the lower surface 26 of the load bars 20. It is preferred that the lower surface 44 of each cross bar 40 be located at about the plane of the neutral axis 22 of the load bars 20, or just slightly below the neutral axis 22. It is additionally preferred that the lower surface 44 of each cross bar 40 be located above the plane of the neutral axis 22 of the load bars 20. The neutral axis 22 is defined as the horizontal plane of the load bar where the bending stress is zero, and it is located at the center of area or centroid of the cross section. Thus while a bar is undergoing bending, the bar is loaded in tension below the neutral axis (i.e., from the neutral axis to the bottom of the bar) and the bar is loaded in compression above the neutral axis. At the neutral axis plane 22, the stress is zero. Since grating structures generally fail in tension, it is important to reinforce the grating below the neutral axis 22. The invention has a strength advantage over prior art molded grating, because the invention has a reduced height of the cross bars 40 which allows the load bars 20 to have longitudinal reinforcement or rovings 30 packed tightly below the neutral axis 22. Prior art grating has significantly less longitudinal rovings than the invention because the rovings of the load bars are interwoven with the rovings of the cross bars. Additionally, the invention has a weight advantage (i.e., reduced weight) and thus a higher strength-to-weight ratio than conventional molded grating because of the need for a reduced number of dross bars 40 because of the uni-directional load design.

As illustrated in FIG. 2, the load bars 20 have rovings 30 placed along the longitudinal axis above and below the neutral axis 22, and are used to carry the compressive and tensile loading. The rovings 30 of the load bars 20 are closely spaced along the longitudinal axis between the lower surface 44 of the cross bars 40 and the lower surface 26 of the load bars 20. Thus an advantage of having a reduced height of the cross bars 40 as compared to the load bars 20 is that the rovings of the load bars 20 may be heavily loaded below the neutral axis since they are not interwoven with the rovings 46 of the cross bars 40. It is additionally preferred that the rovings 30 of the load bars 20 be closely spaced along the longitudinal axis of the bars between the neutral axis 22 and the lower surface of the load bars 20. Above the lower surface 44 of the cross bars 40, the rovings 30 of the load bars 20 are interwoven with the rovings 46 in the cross bars 40. Each cross bar 40 has rovings 46 placed parallel to its longitudinal axis which are interwoven with the rovings 30 in the load bars 20.

The type and number of rovings 30, 46 utilized can be varied to yield the product having the desired strength or density. The rovings 30,46 are continuous fibers with a yield in the range of 28 to 450 yards/pound. It is preferred that the rovings 30,46 have a yield in the range of 56 to 225 yards/pound. It is more preferable that the rovings have a yield in the range of 113 to 225 yards/pound.

It is desirable that the amount of the load bar 20 rovings 30 loaded below the lower surface 44 of the cross bars 40 comprise in the range of 25 to 50 percent by weight of the total roving content of the grating. It is more desirable that the amount of the load bar 20 rovings 30 placed below the lower surface 44 of the cross bars 40 comprise in the range of 30 to 45 percent by weight of the total roving content of the grating. It is highly desirable that the amount of the load bar 20 rovings 30 placed below the lower surface 44 of the cross bars 40 comprise in the range of 32 to 40 percent by weight of the total roving content of the grating.

The rovings 30,46 may be any suitable reinforcement material such as kevlar, rayon, graphite, fiberglass, steel, nylon, tungston, boron, jute, hemp or carbon fiber. It is preferred that the rovings comprise E glass or C glass. It is additionally preferred that the rovings 30,46 be fiberglass for corrosion resistance and for low electrical conductivity. It is preferred that the rovings 30,46 be graphite for enhanced structural strength and stiffness. It is desirable that the grating 10 comprise a total reinforcement content in the range of 20% to 55% by weight of the total grating. It is additionally preferred for enhanced corrosion resistance that the grating 10 comprise a total reinforcement content in the range of 25% to 45% by weight. It is additionally preferred for enhanced structural strength that the grating 10 comprise a total reinforcement content in the range of 30% to 40% by weight.

The integrally molded fiberglass reinforced resin grating article 10 is made from an open mold process which is well known in the art and is briefly described below. The reinforced resin grating 10 is formed in an open mold bed (not shown). The open mold bed can be made of metal such as aluminum or steel or other durable material. The mold bed may be machined or cast as a complete unit or of assembled components having dimensions which are the inverse of the grating.

Next, the type of rovings 30,46 are selected and placed in the mold bed strand by strand. The strands comprising the rovings 30,46 are placed in the mold bed either manually with a tubular probe or by mechanical assistance in any winding pattern such that the rovings are loaded as described above. For example, see the winding pattern disclosed in U.S. Pat. No. 4,382,056 which is hereby incorporated by reference. The rovings 30,46 may be placed in the mold either pre-wet with resin or dry. It is preferred that fiberglass rovings be used and that the fiberglass be completely wetted by the resin. If the fiberglass rovings are placed in the mold dry, then resin must be poured into the mold after a layer or two of fiberglass rovings have been placed in the mold.

Next, plastic resin such as thermoset or thermoplastic resin materials are mixed in a mixing tank utilizing a high shear mixer and then poured into the mold bed, alternating layers of resin and layers of rovings. The thermoset resin materials can be comprised of any number of suitable resin mixtures such as vinyl ester, isopthalic polyester, orthopthalic polyester, terapthalic polyester, MODAR which is an acrylic base resin manufactured by Ashland Chemical Company in Ashland, Ohio, Dicyclopentandione, novalac viny ester, and Bisphenol-A vinyl ester. It is preferred that vinyl ester be utilized for structural strength, toughness, thermal stability and corrosion resistance. Derakane by Dow Chemical Company of Freeport, Tex. is a preferred vinyl ester. It is additionally preferred that novalac vinyl ester be utilized as a resin for enhanced corrosion resistance. If desired, the resin may also contain small concentrations of other additives such as pigments, wetting agents, release agents, ultraviolet absorbers, promoters, chemical thickeners and inhibitors.

It is desirable that tabular alumina having a chemical composition of $Al_2O_3$ and a specific gravity of about 3.55 grams per cubic centimeters, be added to the resin mixture for increased surface hardness, abrasion resistance and durability such that it is approximately in the range of about 5% to about 30% by weight of the total resin mixture. It is more preferred that aluminum oxide be added to the resin mixture for increased surface hardness and durability such that it is approximately 5 to 20% by weight of the resin mixture. It is highly preferable that aluminum oxide be added to the resin mixture for increased surface hardness and durability such that it is approximately 5 to 15% by weight of the resin mixture. Tabular alumina is made by Alu Chem, Inc. of Reading, Ohio, under the trade name of Alu Chem Tabular Alumina. It is desirable that tabular alumina have a mesh size in the range of 250 to 350. It is preferred that tabular alumina have a mesh size in the range of 275 to 350. It is more preferable that tabular alumina have a mesh size in the range of 300 to 325.

Other equivalent material to tabular alumina familiar to those skilled in the art such as tungsten carbide, aluminum oxide, quartz, ceramic or other materials having a Mohs hardness of approximately 7 or greater, may be substituted for tabular alumina. The above materials may also be substituted in combination with each other for tabular alumina, in the amount and size range as indicated, above.

Pressing of the wet roving must occur after each layer of resin has been poured over a layer of rovings, by any suitable device that fits in between the mold bed to remove air entrapped in the resin by the roving layers. Once the resin and reinforcement layers are poured into the mold with the rovings in place, the mold resin system will undergo curing. Curing may occur at either ambient conditions or under heating or cooling. Once the resin system is cured, extraction of the grating from the mold can be accomplished. To ease extraction, use of internal resin releases and external releases such as extraction pins may be utilized.

In a typical integrally molded grating having a 24 foot by 4 foot dimension with a 1 inch by 4 inch mesh size, and a 1.5 inch overall thickness. The cross bars may have a rectangular cross section with an overall vertical height of 0.7 inches, a width of 0.18 inches, and a length of 4 feet. The cross bars may be approximately spaced on 6 inch centers and have fiberglass rovings with a yield of 56 loaded along its longitudinal direction. The load bars may have an overall vertical height of 1.5 inches, a width of 0.18 inches, and a length of 24 feet. The load bars may be spaced on 1.5 inch centers and have fiberglass rovings with a yield of 56 loaded along its longitudinal direction. The load bar rovings are closely spaced from the lower surface of the load bars to the lower surface of the cross bars. Above the lower surface of the cross bars, the load bar rovings are interwoven with the cross bar rovings.

Although the invention has been disclosed and described with respect to certain preferred embodiments, certain variations and modifications may occur to those skilled in the art upon reading this specification. Any such variations and modifications are within the purview of the invention notwithstanding the defining limitations of the accompanying claims and equivalents thereof.

What is claimed is:

1. A reinforced resin grating comprising:

a plurality of load bars having a height dimension, and an upper surface;

a plurality of cross bars having an upper surface and a lower surface;

said cross bars transversely connected to said load bars;

at least one cross bar having a height less than said load bar's height; and said load bars having rovings along its longitudinal axis from its lower surface to the lower surface of said cross bar.

2. The grating of claim 1 wherein all said cross bars have a height less than said load bars.

3. The grating of claim 1 wherein said cross bars are integrally molded with said load bars whereby an integral grating structure is formed having no joints.

4. The grating of claim 1 wherein said upper surfaces of said load bars and said upper surfaces of said cross bars are flush with respect to each other.

5. The grating of claim 1 wherein the spacing of said cross bars is in the range of 2–5 times the spacing of the load bars.

6. The grating of claim 1 wherein said resin further comprises an additive selected from the group comprising: tabular alumina, quartz powder, tungsten carbide powder, ceramic powder, aluminum oxide powder or other material having a Mohs hardness of 7 or higher.

7. The grating of claim 1 wherein said load bars rovings loaded below the lower surface of the cross bars comprise in the range of 25% to 50% by weight of the total grating reinforcement content.

8. The grating of claim 5 wherein said cross bars longitudinal rovings are interwoven with said load bar rovings above said cross bar lower surface.

9. The grating of claim 1 wherein said resin is selected from the group comprising:

vinyl ester, isophthalic polyester, orthopthalic polyester, terapthalic polyester, Modar, Dicyclopentenadione, novalac viny ester, and Bisphenol-A vinyl ester.

10. The grating of claim 1 wherein said cross bars have a cross sectional shape selected from the group comprising: rectangular, square, T-shaped, L-shaped, channel, Double taper, parabolic, m-shaped or I-shaped.

11. The grating of claim 1 wherein said load bars have a cross sectional shape selected from the group comprising: rectangular, square, T-shaped, L-shaped, channel, Double taper, parabolic, m-shaped or I-shaped.

12. The grating of claim 1 wherein said rovings are selected from the group comprising: kevlar, graphite, rayon, fiberglass, E glass, C glass, steel, nylon, tungston, boron, jute, hemp or carbon fiber.

13. The grating of claim 1 wherein said rovings have a yield in the range of 28–450 yards/pound.

14. The grating of claim 1 wherein said load bar rovings placed below the lower surface of the cross bars comprise in the range of 30% to 45% by weight of the total grating reinforcement content.

15. The grating of claim 1 wherein said rovings are tightly spaced below the lower surface of the cross bars.

16. The grating of claim 1 wherein said rovings comprise a total reinforcement content in the range of 20% to 55% of the total grating weight.

17. The grating of claim 1 wherein said load bars are perpendicular to said cross bars.

18. The grating of claim 1 wherein said rovings have a yield in the range of 56 to 225 yards/pound.

19. The grating of claim 1 comprising a thermoset or thermoplastic resin.

20. A reinforced resin grating comprising:

a plurality of load bars having a height dimension, an upper surface and a neutral axis;

a plurality of cross bars having a lower surface and an upper surface;

a plurality of longitudinal rovings in said load bar placed below the neutral axis;

said cross bars being transversely connected to said load bars; and at least one of said cross bars having its lower surface located at about said neutral axis.

21. The grating of claim 20 wherein all said lower surfaces of said cross bars are located at about said neutral axis.

22. The grating of claim 20 wherein said cross bars are integrally molded with said load bars whereby an integral grating structure is formed having no joints or interfaces.

23. The grating of claim 20 wherein said upper surfaces of said load bars and said upper surfaces of said cross bars are flush with respect to each other.

24. The grating of claim 20 wherein the spacing of said cross bars is in the range of 2–5 times the spacing of the load bars.

25. The grating of claim 20 wherein said resin further comprises an additive selected from the group comprising: tabular alumina, quartz powder, tungsten carbide powder, ceramic powder, aluminum oxide powder or other material having a Mohs hardness of 7 or higher.

26. The grating of claim 20 wherein said load bar rovings loaded below the lower surface of the cross bars comprise in the range of 25% to 50% by weight of the total reinforcement content.

27. The grating of claim 5 wherein said cross bars longitudinal rovings are interwoven with said load bar rovings above said cross bar lower surface.

28. The grating of claim 20 wherein said resin is selected from the group comprising: vinyl ester, isophthalic polyester, orthopthalic polyester, terapthalic polyester, Modar, Dicyclopentenadione, novalac viny ester, and Bisphenol-A vinyl ester.

29. The grating of claim 20 wherein said cross bars have a cross sectional shape selected from the group comprising: rectangular, square, T-shaped, L-shaped, channel, Double taper, parabolic, m-shaped or I-shaped.

30. The grating of claim 20 wherein said load bars have a cross sectional shape selected from the group comprising: rectangular, square, T-shaped, L-shaped, channel, Double taper, parabolic, m-shaped or I-shaped.

31. The grating of claim 20 wherein said rovings are selected from the group comprising: kevlar, graphite, rayon, fiberglass, E glass, C glass, steel, nylon, tungston, boron, jute, hemp or carbon fiber.

32. The grating of claim 20 wherein said rovings have a yield in the range of 28–450 yards/pound.

33. The grating of claim 20 wherein said load bar rovings loaded below the lower surface of the cross bars comprise in the range of 30% to 45% by weight of the total reinforcement content.

34. The grating of claim 20 wherein said rovings are tightly spaced below the lower surface of the cross bars.

35. The grating of claim 20 wherein said rovings comprise a total reinforcement content in the range of 20% to 55% of the total grating weight.

36. The grating of claim 20 wherein said load bars are perpendicular to said cross bars.

37. The grating of claim 20 wherein said reinforcement has a yield in the range of 56 to 225 yards/pounds.

38. The grating of claim 20 wherein said resin is thermoset or thermoplastic.

39. The grating of claim 20 wherein said cross bar height is less than half the height of the load bar height.

40. An integrally molded reinforced resin grating comprising:

a plurality of load bars having an upper surface and a neutral axis;

a plurality of cross bars having a lower surface and an upper surface;

a plurality of longitudinal rovings in said load bars placed below the neutral axis;

said cross bars being transversely connected with said load bars; and at least one of said cross bars having its lower surface located above said neutral axis.

41. The grating of claim 40 wherein all of said cross bars have their lower surface located above said neutral axis.

42. The grating of claim 40 wherein said cross bars are integrally molded with said load bars whereby an integral grating structure is formed having no joints.

43. The grating of claim 40 wherein said upper surfaces of said load bars and said upper surfaces of said cross bars are flush with respect to each other.

44. The grating of claim 40 wherein the spacing of said cross bars is in the range of 2–5 times the spacing of the load bars.

45. The grating of claim 40 wherein said resin contains an additive selected from the group comprising: tabular alumina, quartz powder, tungsten carbide powder, ceramic powder, aluminum oxide powder or other material having a Mohs hardness of 7 or higher.

46. The grating of claim 40 wherein said load bar rovings placed below the lower surface of the cross bars comprise in the range of 25% to 50% by weight of the total reinforcement content.

47. The grating of claim 40 wherein said cross bars have longitudinal rovings interwoven with said load bar rovings above said cross bar lower surface.

48. The grating of claim 40 wherein said resin is selected from the group comprising: vinyl ester, isophthalic polyester, orthopthalic polyester, terapthalic polyester, Modar, Dicyclopentenadione, novalac viny ester, and Bisphenol-A vinyl ester.

49. The grating of claim 40 wherein said cross bars have a cross sectional shape selected from the group comprising: rectangular, square, T-shaped, L-shaped, channel, Double taper, parabolic, m-shaped or I-shaped.

50. The grating of claim 40 wherein said load bars have a cross sectional shape selected from the group comprising: rectangular, square, T-shaped, L-shaped, channel, Double taper, parabolic, m-shaped or I-shaped.

51. The grating of claim 40 wherein said rovings are selected from the group comprising: kevlar, graphite, rayon, fiberglass, E glass, C glass, steel, nylon, tungston, boron, jute, hemp or carbon fiber.

52. The grating of claim 40 wherein said rovings have a yield in the range of 28–450 yards/pound.

53. The grating of claim 40 wherein said rovings located below the lower surface of the cross bars comprise in the range of 30% to 45% by weight of the total reinforcement content.

54. The grating of claim 40 wherein said rovings are tightly spaced below the lower surface of the cross bars.

55. The grating of claim 40 wherein said rovings comprise a total reinforcement content in the range of 20% to 55% of the total grating weight.

56. The grating of claim 40 wherein said load bars are perpendicular to said cross bars.

57. The grating of claim 40 wherein said reinforcement has a yield in the range of 56 to 225 yards/pound.

58. The grating of claim 40 wherein said resin is thermoset or thermoplastic.

59. The grating of claim 40 wherein said cross bar height is less than half the height of the load bar height.

60. A reinforced resin grating comprising:

a plurality of load bars;

a plurality of cross bars transversely connected with said load bars;

said cross bars and said load bars having longitudinal reinforcement;

said cross bar reinforcement interwoven with said load bar reinforcement; and said resin comprising an additive selected from the group comprising: tabular alumina, quartz powder, tungsten carbide powder, ceramic powder, aluminum oxide powder or other material having a Mohs hardness of 7 or higher.

61. The grating of claim 60 wherein said additive comprises in the range of about 5% to about 30% by weight of the total resin mixture.

62. The grating of claim 60 wherein said additive comprises in the range of about 5% to about 20% by weight of the total resin mixture.

63. The grating of claim 60 wherein said additive comprises in the range of about 5% to about 15% by weight of the total resin weight.

64. The grating of claim 60 wherein said additive has a mesh size in the range of about 250 to about 350.

65. The grating of claim 60 wherein said additive has a mesh size in the range of about 275 to about 350.

66. The grating of claim 60 wherein said additive has a mesh size in the range of about 300 to about 325.

* * * * *